United States Patent [19]

Longhouse et al.

[11] Patent Number: 4,685,513

[45] Date of Patent: Aug. 11, 1987

[54] ENGINE COOLING FAN AND FAN SHROUDING ARRANGEMENT

[75] Inventors: Richard E. Longhouse, Dayton; Nick Vona, Springboro, both of Ohio

[73] Assignee: General Motors Corporation, Detroit, Mich.

[21] Appl. No.: 665,412

[22] Filed: Oct. 24, 1984

Related U.S. Application Data

[63] Continuation of Ser. No. 324,611, Nov. 24, 1981, abandoned.

[51] Int. Cl.[4] ..... F01D 5/22; F01P 7/10

[52] U.S. Cl. ..... 165/121; 165/51; 123/41.49; 415/182; 415/172 A; 416/189; 416/192; 416/234; 416/238

[58] Field of Search ..... 165/121, 122; 123/41.49; 62/244; 415/172 A, 182, 212, 213 C, 219 R; 416/236 R, 236 A, 189, 192, 169 A, 234, 238

[56] References Cited

U.S. PATENT DOCUMENTS

| | | | |
|---|---|---|---|
| 3,795,274 | 3/1974 | Fieni | 165/122 |
| 4,194,556 | 3/1980 | Watanabe et al. | 123/41.49 |
| 4,329,946 | 5/1982 | Longhouse | 123/41.49 |
| 4,351,162 | 9/1982 | Yee | 62/244 |
| 4,358,245 | 11/1982 | Gray | 123/41.49 |
| 4,396,351 | 8/1983 | Hayashi et al. | 416/189 R |
| 4,505,641 | 3/1985 | Tsuchikawa et al. | 416/192 |

FOREIGN PATENT DOCUMENTS

| | | | |
|---|---|---|---|
| 2156978 | 5/1972 | Fed. Rep. of Germany | 416/238 |
| 0147508 | 11/1979 | Japan | 415/182 |

*Primary Examiner*—William R. Cline
*Assistant Examiner*—John K. Ford
*Attorney, Agent, or Firm*—Charles R. White

[57] ABSTRACT

Compact fan and shroud package for radiators with fan blades curved rearwardly to position rotating shroud at optimized distance from radiator for improved air flow through radiator.

4 Claims, 4 Drawing Figures

ENGINE COOLING FAN AND FAN SHROUDING ARRANGEMENT

This is a continuation of application Ser. No. 324,611 filed on Nov. 24, 1981, now abandoned.

This invention relates to vehicle engine cooling and more particularly to a new and improved multibladed engine cooling fan and fan shrouding arrangement which operates with high efficiency and reduced noise level in providing improved flow of cooling air through a radiator while requiring minimized engine compartment space.

Prior to the present invention, various engine cooling fan and fan shrouding arrangements have been provided for vehicles which have increased fan efficiency and reduced noises generated by the fan. In some of the more advanced designs, a fixed shroud and bracket construction has been utilized to centrally support a fan motor so that a shrouded fan driven thereby is effectively immersed within the fixed shroud to provide for improved fan operation. To provide for quantity flow of air through the radiator outside of the area immediately in front of the fan, it was necessary to slant the shrouded fan at an angle with respect to the radiator to open up the fan to the radiator for the improved side flow of air into the fan. Because of space restrictions in crowded engine compartments and higher standards for engine cooling, compact fan and fan shroud packages are needed which will pump larger volumes of air through larger areas of the radiator for more effective transfer of the heat energy from the engine coolant circulated therein.

To this end, this invention incorporates an enveloping shroud which is fixed with respect to the engine cooling radiator and which has integral bracket structure for supporting the fan motor centrally therein. The fan motor drives a multibladed fan which has specialized blading for pumping air with improved efficiency and quietness and also for supporting a rotating shroud immersed within the fixed shroud so that there is highly effective pneumatic sealing of the recirculating flow paths between the fixed and rotating shroud. More particularly, in this invention the spaced and outwardly extending fan blades are curved rearwardly to effectively support a rotating shroud a predetermined distance from the rear face of the radiator. With this rearward position of the rotating shroud, the radiator is effectively opened to the fan for increased side flow of air into the fan and increased cooling of the coolant circulation in the radiator. Additionally, the rearwardly curved blades have a curved leading edge to progressively cut into any air turbulence to reduce blade generated noises.

This fan and fan shroud arrangement further allows the shrouding to be squarely mounted with respect to the radiator and provides for a thinner package for increased clearance between the fan components and the vehicle engine to reduce the possibility of heat degradation and to facilitate servicing.

These and other features, objects and advantages of this invention will be more apparent from the following detailed description and drawing in which.

Figure 1:
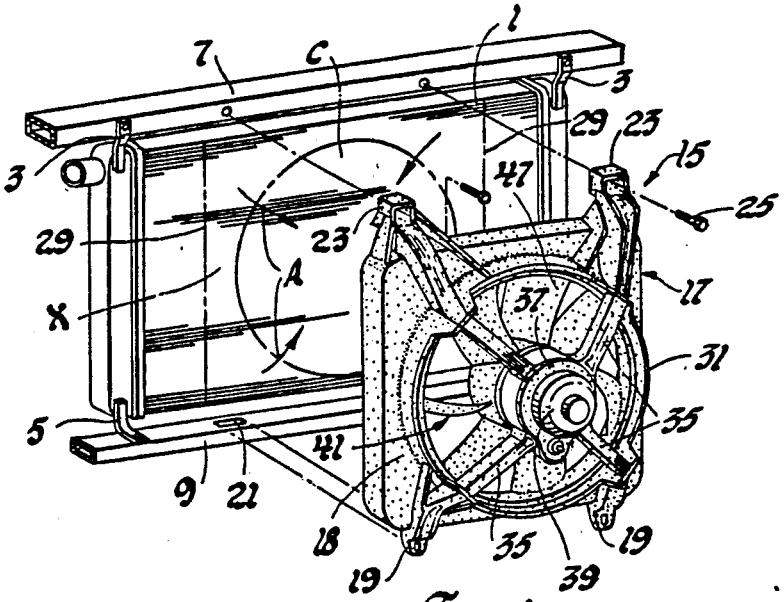
FIG. 1 is an exploded perspective view of an automotive engine cooling radiator, cooling fan and fan shrouding package, embodying a preferred embodiment of this invention.

Turning now in greater detail to FIG. 1, there is shown a conventional engine cooling radiator 1 connected by brackets 3 and 5 to elongated upper and lower horizontal radiator supports 7 and 9. The radiator 1 is preferably positioned at the front of the vehicle on the outboard side of a transversely mounted internal combustion engine 11 diagrammatically illustrated in FIG. 2. Engine 11 is hydraulically connected by suitable hoses to the radiator so that engine cooling fluids can circulate therebetween and the heat energy can be dispersed in the radiator.

Figure 2:
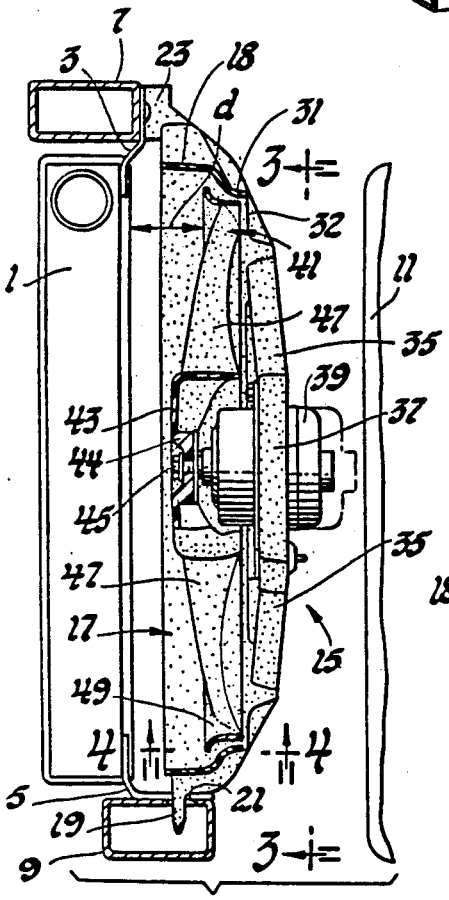
FIG. 2 is a side view partially in section of the fan and shroud assembly of FIG. 1 as connected to the radiator and supports therefor.

Disposed between the radiator and the engine is a cooling fan and shroud assembly 15 for inducing a flow of air through the radiator on demand by conventional thermostatic controls not shown. This assembly includes a fan mounting bracket and fixed shroud unit 17 preferably molded from a suitable plastic material. The unit 17 has a box-like main shell 18 with laterally spaced and downwardly projecting mounting legs 19 which fit into corresponding recesses 21 in the lower horizontal support 9. Upwardly extending mounting legs 23 have openings formed therein through which threaded fasteners 25 extend and into threaded connection with upper radiator support 7 to thereby secure the unit 17 behind the radiator. The main shell 18 has an open front that covers area x of the radiator. The laterally spaced vertical lines 29—29 of FIG. 1 illustrate the side boundary of area X and the extent of coverage of the fixed shroud. The main shell has a rearwardly extending ejector 31 integral with the main shell 18 which has a bell-mouthed inlet portion and an axially extending cylindrical body portion that terminates rearwardly in an annular edge 32. Extending radially inwardly from the cylindrical body portion of the ejector 31 are four arcuately spaced spokes 35 which support at their inner ends an annular mounting ring 37 that has a centralized opening for receiving and supporting a generally cylindrical electrical fan drive motor 39. This motor has an output shaft which drives a fan and rotating shroud unit 41 molded from a suitable plastic material. The fan and shroud unit has a thin-walled cup-like hub 43, in which the motor 39 is partially immersed and as shown in FIG. 2, the hub 43 has a thickened centralized mount or mounting collar 44 which is drivingly connected to the output shaft of the motor by threaded fasteners 45. A plurality of thin fan blades 47 curve rearwardly from the outer periphery of the hub into tip connection with an inner wall of a bell-mouthed rotating shroud 49. With this construction, the rotating shroud is backed off of and squared with respect to the rear face of the radiator to an extent in which there is quantity side flow of air illustrated by flow arrows A into a low pressure area, indicated by circle C on the radiator which is immediately in front of the fan and which generally corresponds to the diameter of the fan. This provides for improved radiator cooling by the shrouded fan since there is high volume flow through the radiator immediately in front of the fan, i.e. circle C and additionally substantial air flow through the radiator core outside of circle C covered by the fixed shroud as indicated by the side flow arrows A. From this region of low pressure, the fan discharges air into the engine compartment. Recirculation of air from the engine compartment into the entrance of the fan is retarded by the shroud configuration as explained in U.S. Pat. No. 4,329,946 for SHROUD ARRANGEMENT FOR ENGINE COOLING FAN, filed Mar. 10, 1980 and assigned to the assignee of this invention.

Figure 4:
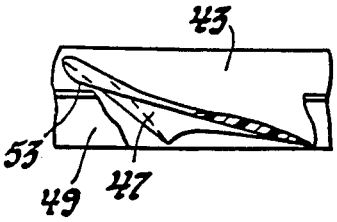
FIG. 4 is a plan view of a portion of the fan and shroud with parts broken away taken generally along lines 4—4 of FIG. 2.

FIG. 4 illustrates the configuration of blades 47 in providing the rearward set back of the rotating shroud 49 with respect to the forward face of the hub. If the blades had no significant rearward and curvature, the rotating shroud would be positioned substantially closer to the rear face of the radiator such as along the plane through a vertical line along the front face of hub 43 for example. With such location, most of the air pumped through the radiator would be through the area of circle C and the side flow would be substantially diminished.

Figure 3:
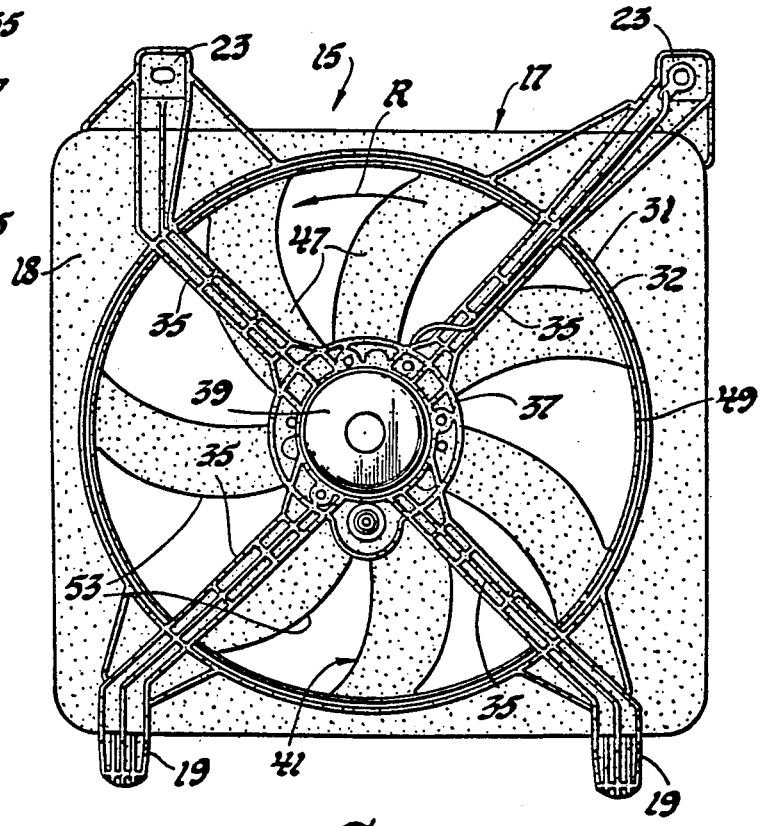
FIG. 3 is an end view taken along lines 3—3 of FIG. 2 with some components removed.

In addition to providing for improved fan cooling operation through rotating shroud positioning, the fan blades provide for more efficient and quieter pumping. The thin leading edges 53 of the extending fan blades are arcuately curved in the direction of rotation indicated by arrow R in FIG. 3 while sweeping rearwardly into connection with the rotating shroud so that they progressively slice into any substantial turbulent air flow. With such encounter, there is reduced fan noise as compared to fans with little or no curvature in the leading edge of their blades. After entering the blades the twist in the air foil section from the hub to the rotating shroud illustrated in FIG. 4 provides for high efficiency pumping without substantial flow separation.

While a preferred embodiment has been shown and described to illustrate this invention, other embodiments employing the concepts and ideas of this invention will now become apparent to those skilled in the art. Accordingly, the scope of this invention is set forth in the following claims.

The embodiments of the invention in which an exclusive property or privilege is claimed are defined as follows:

1. Vehicle engine cooling fan and shrouding assembly for forcing cooling air through a radiator in which engine coolant is circulated comprising support means adjacent to the radiator, a fan shroud and mounting shell operatively secured to said support means adjacent to said radiator, said shell having a peripheral forwardly extending wall portion to provide an intake for air flowing through said radiator, said shell further having a generally cylindrical and rearwardly extending portion to provide a reduced dimensioned air ejector for said shell, spoke means extending inwardly from said air ejector, a fan drive motor supported by said spoke means extending axially into said shell, said motor having a rotatable output shaft extending outwardly therefrom toward said radiator and having a terminal end portion, an engine cooling fan operatively driven by said drive motor and rotatably mounted in said shell, said fan having an annular hub with a cylindrical wall and a forward face disposed in a first plane rearward of and generally parallel to said radiator, a plurality of arcuately spaced blades extending generally radially outward from cylindrical wall of said hub, each of said blades having a convex front edge that sharply sweeps rearward from a respective point of attachment to said cylindrical wall of said hub closely adjacent to the forward face of said hub and said first plane thereof to a terminal end point in a second plane rearwardly of said first plane that extends through at least one half of the width of said cylindrical wall starting from the forward face of said hub, and an annular shroud securely fixed to the terminal end points of said blades for rotation therewith in said air ejector, said annular shroud being located radially inward of said wall portion and in a plane generally parallel to the radiator, said forward face of said hub having a centralized mount collar, fastener means securing said central mount collar to said end portion of said output shaft of said drive motor, said annular shroud being axially positioned by said blades for rotation in a plane substantially rearward of and axially spaced from said mount collar and at a predetermined spacing from said radiator whereby high volumes of air flowing through said radiator peripheral to said annular shroud and into the fixed shell turns generally radially inward and from all sides into the rotating shroud for intermixture with high volume air flowing into the fan from an area immediately in front of said rotating shroud for rearward discharge by said fan.

2. Vehicle engine cooling fan and shrouding assembly for forcing cooling air through a radiator forwardly mounted in a vehicle in which engine coolant is circulated comprising support means adjacent to the radiator, a fixed fan shroud operatively secured to said support means adjacent to said radiator, said fixed shroud being a box-like open-faced shell having a peripheral forwardly extending wall portion, said wall portion having a terminal forward edge adjacent to the rearward face of said radiator to provide a large area intake for air flowing therethrough, said shell further having a generally planar rear wall portion terminating in a rearwardly extending cylindrical projecting portion to provide a reduced dimensioned annular air ejector for said fixed shroud, spoke means extending inwardly from said air ejector and terminating in a drive motor mount, a fan motor supported by said drive motor mount and extending axially into said shell, said drive motor having an output shaft extending toward said radiator, a fan operatively connected to said drive motor for rotation in said shell and said air ejector, said fan defining an area substantially smaller than that of said large area intake and having a central hub with a forward face, said forward face being in a plane substantially parallel to the plane of said radiator, a centralized mount projecting from said forward face, fastener means extending through said mount for operatively connecting said fan to said output shaft of said motor, a plurality of arcuately spaced blades, each of said blades having a backwardly swept and convex front edge extending radially outwardly from respective points of attachment to said hub which are substantially in the same plane as said forward face to a terminal end portion axially offset rearwardly a substantial distance from the forward face of said hub, an annular shroud securely fixed to the outer end portions of said blades for rotation therewith and within said reduced diameter air ejector, said annular shroud being axially and backwardly positioned by said blades for rotation in a plane spaced at a substantial distance from and generally parallel to said radiator and rearwardly spaced from said plane of said face of said hub to aerodynamically open and increase the air space between said fan and said annular shroud with respect to said radiator for materially increasing the flow of air through said radiator into said fixed shell and the pumping of said flow by said fan.

3. Vehicle engine cooling fan and shrouding assembly for forcing cooling air through a radiator in which engine coolant is circulated comprising support means adjacent to the radiator, a fixed fan shroud operatively secured to said support adjacent to and in substantial parallel relationship with said radiator, said fixed shroud having a peripheral forwardly extending wall portion to provide an intake for air flowing through the radiator, said fixed shroud further having a generally cylindrical and rearwardly extending air discharge portion to provide a reduced dimensioned air ejector for said fixed shroud, spoke means extending inwardly from said air ejector, motor mounting means carried by the inner ends of said spoke means, a fan drive motor supported by said motor mounting means, said drive motor extending axially into said fixed shroud and having an output shaft, a fan operatively mounted in said fixed shroud, said fan having a hub with a forward face extending in a plane generally parallel to the plane of said radiator, said face of said hub having a centralized mount, fastener means extending through said mount for securing said fan to the end of the output shaft of said motor, a plurality of arcuately spaced blades secured on said hub having convex leading edges secured at points of attachment to said hub substantially in the plane of said forward face and reversely curved in the direction of rotation and backwardly swept from said radiator and said front face of said hub, said blades extending generally radially outward from said hub to end portions, an annular shroud securely fixed to the end portions of said blades for rotation in a plane axially offset rearwardly a substantial distance from the plane of said face of said hub, said annular shroud having an area substantially less than the area of said wall portion of said fixed shroud for rotation in an immersed position in said air ejector and axially positioned by said blades at predetermined and optimized offset spacing from said centralized mount and said radiator whereby there is optimized flow of air through said radiator bounded by said wall portion of said shell and then generally radially into said shrouded fan for discharge through said ejector by operation of said fan.

4. Vehicle engine cooling fan and shrouding assembly for forcing cooling air through a radiator forwardly mounted in a vehicle and in which engine coolant is circulated comprising support means adjacent to the radiator, a fan shroud and fan mounting shell operatively secured to said support means adjacent to said radiator, said shell having a peripheral and forwardly extending wall extending forwardly to a front edge to provide a large area intake for air flowing through the radiator, said shell further having a generally cylindrical and rearwardly extending portion to provide a reduced dimensioned air ejector for said shell, spoke means extending inwardly from said air ejector, a fan drive motor supported by said spoke means extending axially into said shell and having an output shaft, a fan operatively connected to said drive motor and rotatably mounted in said shell, said fan having a central hub, said hub having a forward face rotatable in a plane and a central mounting collar, fastener means extending through said central mounting collar to operatively secure said fan to said output shaft, said hub having a peripheral wall extending around a forward portion of said motor, said fan having a plurality of arcuately spaced blades, each of said blades having a convex and backwardly swept front edge extending radially outwardly from said peripheral wall of said hub and substantially in the same plane as said forward face and to an outer end point in a plane located at a substantial distance rearward of said plane of said forward face of said hub and within said air ejector, an annular shroud having an area substantially smaller than said area of said intake and fixed to the outer end portions of said blades for rotation therewith in said air ejector, said annular shroud being axially and backwardly positioned in said ejector by said blades for rotation in a plane generally parallel to and at predetermined spacing from said radiator and from the front edge of said peripheral wall of said shell, said shroud being axially offset rearwardly with respect to said forward face of said hub and thereby from said radiator to aerodynamically open and materially increase the spacing between said fan and said radiator for increasing air flow through said radiator as defined by the front edge of said shell and into said fan for discharge thereby.

* * * * *